United States Patent [19]

Wolf

[11] 3,999,226

[45] Dec. 28, 1976

[54] TOILET SANITIZER WITH DISPOSABLE CONTAINER

[76] Inventor: Tobin Wolf, 285 Aycrigg Ave., Passaic, N.J. 07055

[22] Filed: June 23, 1975

[21] Appl. No.: 589,530

[52] U.S. Cl. ..... 4/225; 4/227; 4/228; 222/57; 222/383

[51] Int. Cl.[2] ..... E03D 9/02; B67D 5/40

[58] Field of Search ..... 222/57, 209, 383, 400.7; 4/222, 223, 224, 225, 227, 228, 230

[56] References Cited

UNITED STATES PATENTS

| | | | |
|---|---|---|---|
| 713,977 | 11/1902 | Gallagher | 4/229 |
| 2,065,131 | 12/1936 | Hall | 222/400.8 |
| 2,397,677 | 4/1946 | MacGlashan | 4/224 |
| 2,558,469 | 6/1951 | Travls | 4/228 |
| 2,946,065 | 7/1960 | Smith | 4/223 |
| 3,828,985 | 8/1974 | Schindler | 222/209 X |
| 3,890,657 | 6/1975 | Gray | 4/228 |

FOREIGN PATENTS OR APPLICATIONS

| | | | |
|---|---|---|---|
| 94,775 | 11/1962 | Denmark | 4/227 |
| 1,494,968 | 9/1967 | France | 4/224 |

*Primary Examiner*—Allen N. Knowles
*Assistant Examiner*—Hadd Lane
*Attorney, Agent, or Firm*—Jay M. Cantor

[57] ABSTRACT

The disclosure relates to a sanitizer/deodorant for a toilet bowl wherein the sanitizer/deodorant is placed into the toilet bowl rather than the flush tank after the toilet has been flushed to maintain a high concentration of the sanitizer/deodorant in the bowl between flushings and provide maximum sanitizer/deodorant utilization. The above is provided by means of a pump operated by the rise of water in the tank, operation of the pump causing a measured amount of sanitizer/deodorant to pass through a tube into the bowl through the overflow tube after the stopper ball has closed off the exit from the tank to the bowl. The metering is provided by the controlled amount the bellows is allowed to expand and compress.

15 Claims, 10 Drawing Figures

Fig. 4
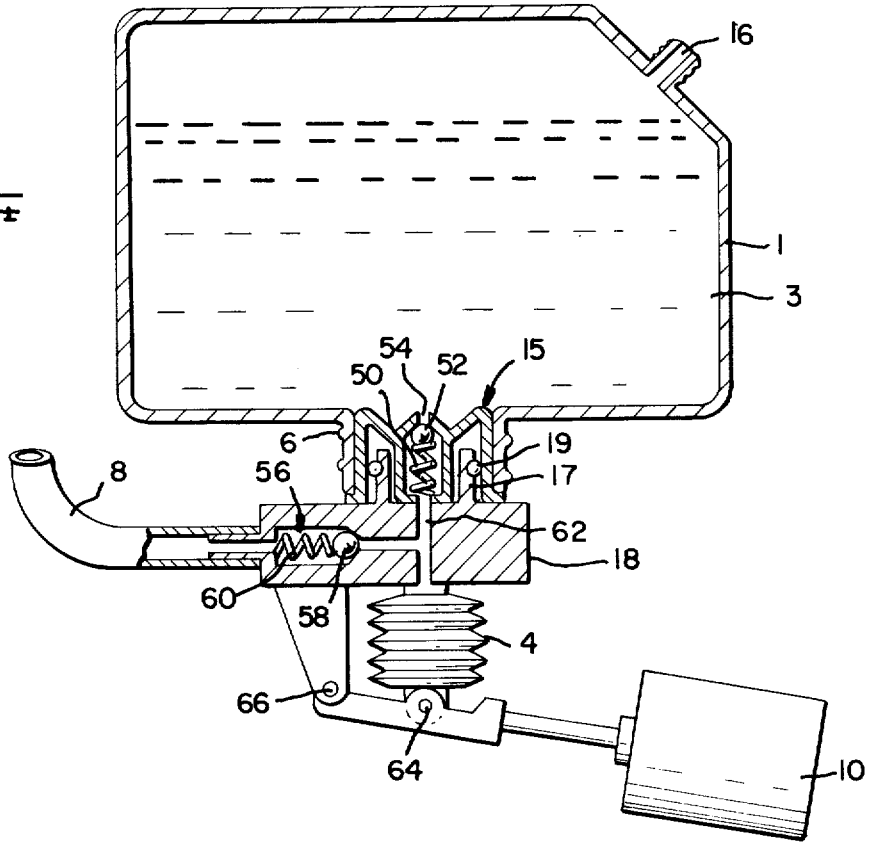
Fig. 5
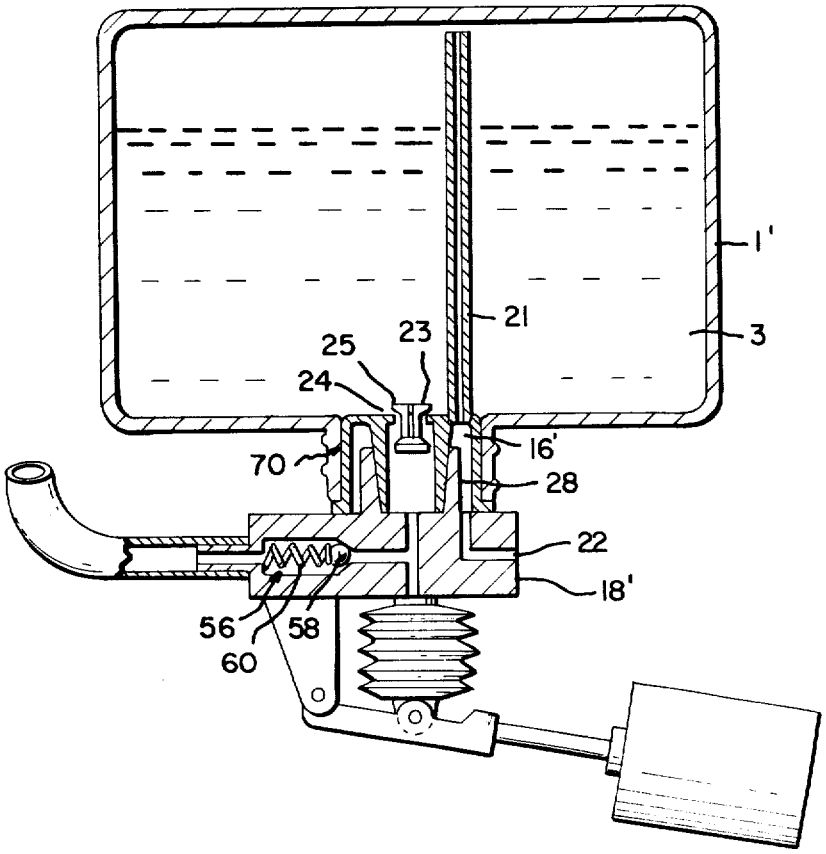
Fig. 5b
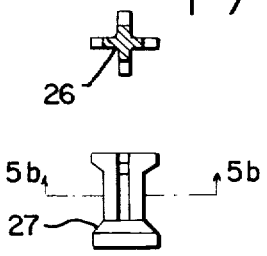
Fig. 5c

TOILET SANITIZER WITH DISPOSABLE CONTAINER

This invention relates to a disposable container for use as a dispenser of sanitizer or disinfectant/deodorant for a toilet bowl and, more specifically, to a dispenser which places a predetermined amount of said sanitizer/deodorant into a toilet bowl after flushing and also after water from the tank has ceased to pass into the bowl so that a full measure of the sanitizer/deodorant is actively disposed in the bowl between flushings and is an improvement over my prior copending application, Ser. No. 510,995, filed Oct. 1, 1974 and U.S. Pat No. 2,853,715.

Although there are many, so called, automatic toilet bowl cleaners and deodorizers presently available, their method of dispensing severely limits their efficiency, particularly with respect to odor prevention. This is because most prior art systems dispense their ingredients into the flush tank. When the toilet is flushed, almost the entire contents of the tank flushes down the drain. The small amount of treated water remaining in the bowl is then severely further diluted by the fresh water fed into the bowl by the refill tube. This results in a waste of the cleaner or deodorizer as well as to a relatively small quantity thereof remaining. Furthermore, in prior art toilet sanitizers which utilize a container within the tank for storing the deodorizer and/or disinfectant, refilling of such container can result in spillage into the tank or onto the hands of the user. This is undesirable, not only due to waste, but also because the spilled material often contains dies or caustic materials.

In accordance with the present invention, there is provided a disinfectant/deodorant dispenser for a toilet which overcomes the problems of the prior art and provides a full measure of disinfectant/deodorizer in the bowl for substantially the entire period between flushings as in my above noted application and also prevents spillage. Briefly, the above is accomplished wherein the sanitizer/deodorant is placed into the toilet bowl rather than the flush tank after the toilet has been flushed to maintain a high concentration of the sanitizer/deodorant in the bowl between flushings. The above is provided by means of a pump operated by the rise of water in the tank, operation of the pump causing a measured amount of sanitizer/deodorant to pass through a tube into the bowl through the overflow tube after the stopper ball has closed off the exit from the tank to the bowl. The metering is provided by means of a bellows, whereby the quantity metered is controlled by the amount the bellows is compressed. The container holding the disinfectant/deodorant is separable from the float operated pump and is replaceable and can be disposable. The replaceable container includes, as a part thereof, the pump intake valve which is spring loaded or otherwise formed so that the liquid within the container cannot pass through the intake valve unless the container is mounted on the pump assembly.

It is therefore an object of this invention to provide a replaceable dispenser for dispensing a liquid into a toilet bowl after completion of a flushing operation.

It is a further object of this invention to provide a replaceable dispenser actuated by the rise of water in a toilet flush tank to dispense a measured amount of liquid into the toilet bowl after a flushing operation.

It is a still further object of this invention to provide a liquid container for use with a pump wherein the pump intake valve is a part of the container.

It is a yet further object of this invention to provide a liquid container for use with a pump wherein the pump intake valve is a part of the container and is rendered closed when the container is not mounted on the pump mechanism.

The above objects and still further objects of the invention will immediately become apparent to those skilled in the art after consideration of the following preferred embodiments thereof, which are provided by way of example and not by way of limitation, wherein:

FIG. 4 is a cross-sectional view of a toilet sanitizer in accordance with the present invention;

FIG. 5 is a cross-sectional view of a toilet sanitizer in accordance with a second embodiment of the present invention;

Figure 6:
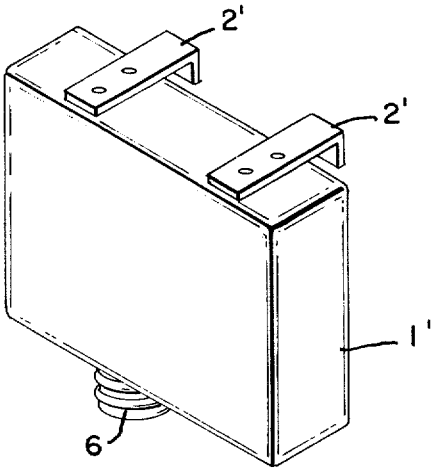
Figure 7:
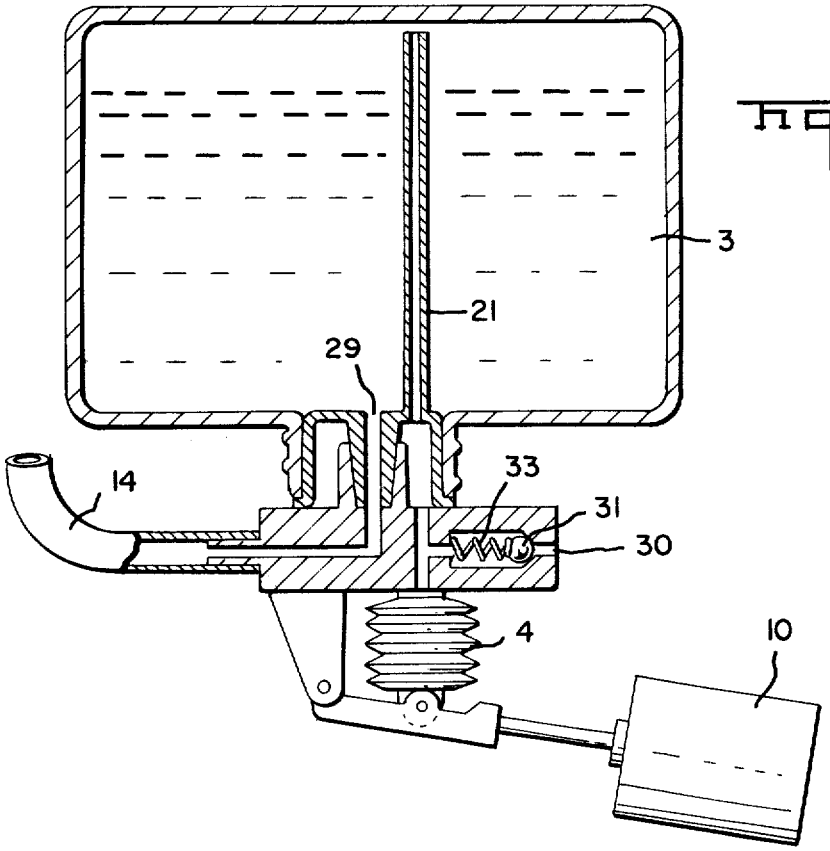
Figure 8:
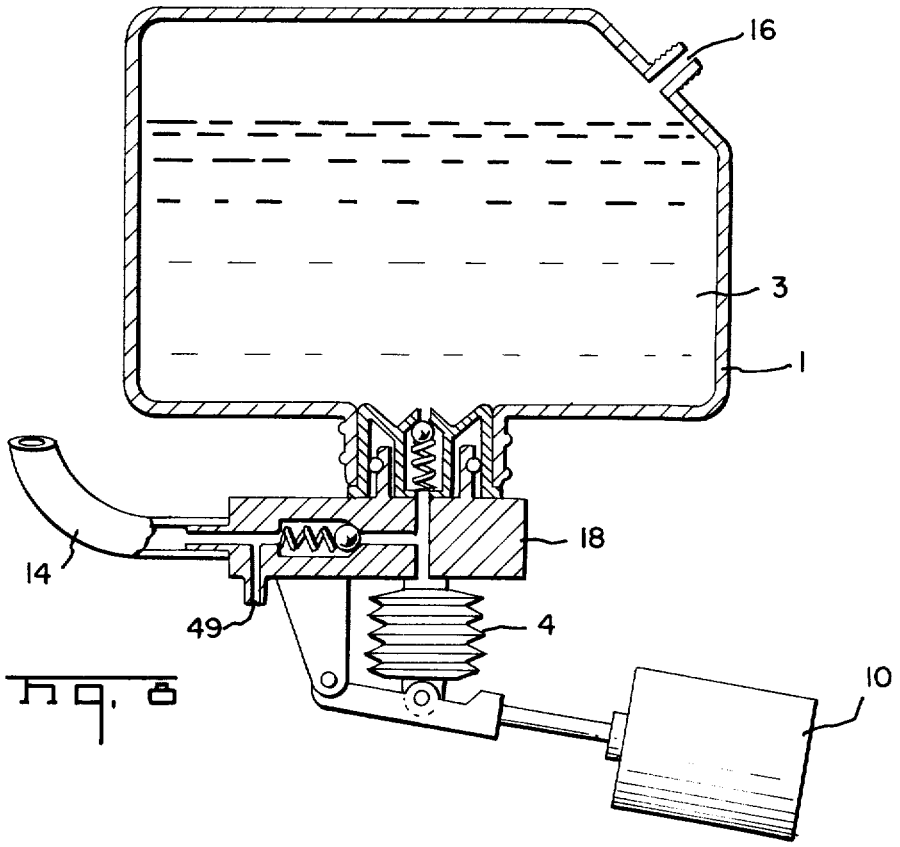

FIG. 5*a* is an enlarged view of the slug of FIG. 5;

FIG. 5*b* is a view taken along the line 5*b*—5*b* of FIG. 5*a*:

FIG. 6 is an elevational view of another manner of mounting the pump and container;

FIG. 7 is a cross-sectional view of a third embodiment of the present invention; and FIG. 8 is a cross-sectional view of a fourth embodiment of the present invention.

Figure 1:
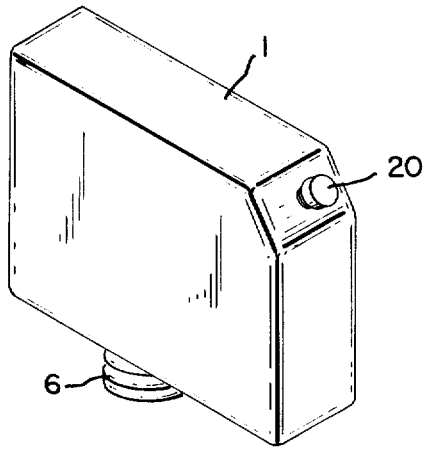
FIG. 1 is an elevational view of the container of the present invention.

Referring first to FIG. 1, there is shown a container 1 having a threaded vent 16 (FIG. 4) with a cap 20 thereon. The vent 16 is positioned preferably above the level of liquid in container 1 when the container is mounted on a pump mechanism. The container 1 also includes a threaded outlet 6.

Figure 2:
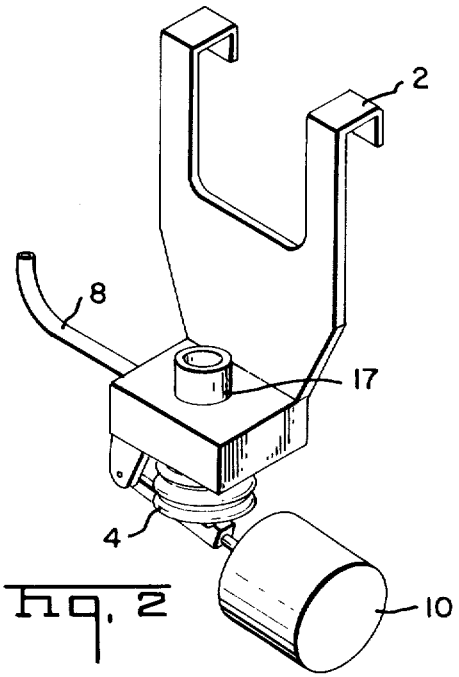
FIG. 2 is an elevational view of the pump mechanism for use with the container in accordance with the present invention.

The pump mechanism or assembly is shown in FIG. 2 and includes a bellows 4, a float 10 for operating the bellows, a bracket 2 for mounting the assembly in the tank, a dispensing tube 8 and a sleeve 17 onto which the container 1 is mounted. The container 1 mounted on the pump assembly is shown in FIG. 3.

Figure 3:
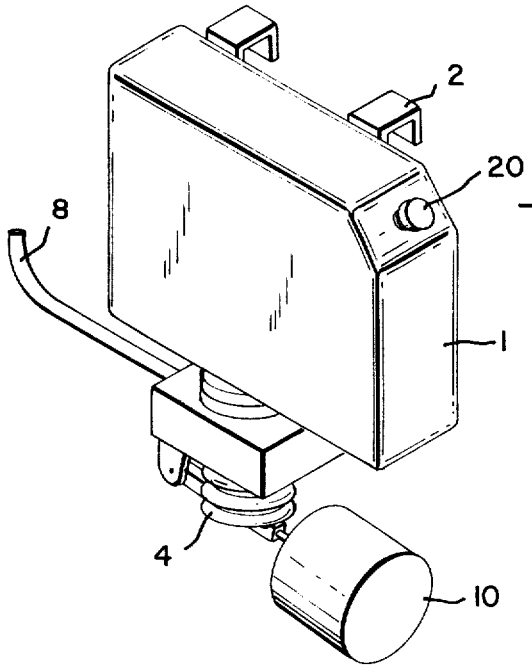
FIG. 3 is an elevational view of the container of FIG. 1 and the pump mechanism of FIG. 2 connected together.

Referring now more specifically to FIG. 4, there is shown a cross-section of the container and pump assembly of FIG. 3. The container 1 includes sanitizer/deodorant or the like 3, vent 16 above the surface of the liquid to equalize the air pressure in the container during operating and an insert 15 in the threaded outlet 6. The insert 15 can be integral with the container 1 or frictionally or otherwise secured in the outlet in watertight manner to prevent liquid 3 from passing therethrough except during pump operation. The insert 15 forms the intake valve for the pump and includes a spring 50 which biases a ball 52 into the opening 54 to maintain the valve closed except when a vacuum is created below the ball as will be described hereinbelow. The sleeve 17 on the pump body 18 serves to align and mount the container 1, the elastomeric O-ring 19 insuring a fluid-tight seal by preventing fluid from leaking between the pump body and the insert to the exterior. The pump body 18 further includes an exhaust valve 56 having a ball 58 and a spring 60 therein, the valve communicating with a T-shaped channel 62 interconnecting the intake valve 15, the exhaust valve 56 and the bellows 4. A dispensing tube 8 is connected to the exhaust valve and the flow 10 is coupled via pivot 64 to the bellows 4, the float being movable about pivot 66.

When the toilet is flushed, the toilet stopper ball (not shown) is lifed and allows water to travel from the flush tank (not shown) through the outlet from the tank (not shown) to the toilet bowl, thereby allowing float 10 to fall to its lowermost position. This will cause the bellows 4 to expand and create a pressure-drop in the region between valves 15 and 56 in the channel 62 and within the bellows, thereby causing liquid 3 to flow past valve 15. When the pressure is equalized, the spring 50 will force ball 52 against the valve seat to prevent any further inflow of liquid. When the water from the flush tank (not shown) has emptied, the stopper ball will close the tank outlet in standard manner, thereby allowing the tank to fill with water. When the water level in the tank reaches float 10, the float is forced upward, thus compressing the bellows 4, thereby applying a pressure to the liquid in the bellows and the region 62 between valves 15 and 56 and pumping a measured amount of liquid past valve 56 along tube 8 to the overflow tube (not shown) and into the bowl. The liquid will remain in the bowl until the next flushing operation whereupon the entire cycle is repeated.

Referring now to FIGS. 5, 5a and 5b, there is shown a second embodiment of the invention. In this embodiment the vent 16 and cap 20 are replaced by a vent tube 21 which communicates with a vent hole 16' in the insert 70. The vent tube 21 diminishes the possibility of leakage through the vent hole 16 should the cap 20 loosen in shipment. The pump body 18' includes a passage 22 which communicates with the external atmosphere and vent hole 16'.

In addition, the intake valve is altered by the replacement of the ball and spring with a floating slug 23 which is captured within the valve opening 24 by the ears 25. An enlarged view of slug 23 is shown in FIG. 5a with a cross-section thereof in FIG. **5*b*. The X section 26 permits flow when the valve is in the down position while the bevelled surface 27 prevents flow when slug 23 is in the upward position. Therefore, flow out of the container 1' is permitted but back flow into the container is prevented. The tapered sleeve 28** eliminates the need for the elastomeric O-ring seal due to the tight friction fit obtained.

Referring now to FIG. 6 there is shown a second embodiment of a mounting bracket. Here the mounting bracket 2' is affixed to the container 1' instead of being a part of the pump assembly as in FIGS. 2 and 3.

Referring now to FIG. 7, there is shown a third embodiment of the present invention. The embodiment of FIG. 7 differs from the embodiment of FIG. 5 by removal of the slug 23 and the valve mechanism 56 including ball 58 and spring 60 and replacement with an opening and path 29 from the container directly to the dispensing tube 14. In addition, the hole 22 of FIG. 5 is replaced by an intake valve 30 including a ball 31 and spring 33.

In the embodiment of FIG. 7, the rising water in the tank lifts the float 10 and compresses the bellows 4 and the air therein, this increasing the pressure in the space of the liquid 3. This increase in pressure forces the liquid 3 out through the opening 29 to the dispensing tube. The ball 31 and spring 33 will close the valve 30 and not permit the air to flow out therethrough. The bellows 4 is filled with air through valve 30 when the water level in the tank is falling. This is caused by the expansion of the bellows 4 as the float 10 drops, thereby causing a partial vacuum in the bellows and the interior of valve 30 and allowing air to pass into valve 30 from the outside to equalize the pressure. The bias from the spring will, of course, be adjusted to permit the required air entry under the conditions of vacuum created.

It is possible to completely eliminate intake valve 30, thereby allowing air to be bubbled into container 1 through the dispensing tube 14.

Referring now to FIG. 8, there is shown a still further embodiment of the invention. This embodiment is identical with the embodiment of FIG. 4 except that a further outlet 48 is provided so that liquid will flow to the bowl (not shown) via dispensing tube 14 and also into the tank (not shown) via outlet 49. The major liquid flow will be via dispensing tube 14, the ratio being determined by the size of the orifice at outlet 49.

While the exhaust valve as shown in FIGS. 4, 5, 7 and 8 is located in the pump body, it is also possible to place such exhaust valve in the insert 15.

As a further embodiment, the intake valve and exhaust valve can both be disposed in the pump body 18 and the disposable container 1 has a very small outlet hole or exit orifice so that, if the vent 16 is not opened, then there is little, if any, chance for liquid to leave the container when the container is inverted. In this case, the outlet from container 1 would be a very small orifice or the insert would include only a small orifice and none of the pump assembly.

It is readily apparent that the inserts noted hereinabove can also be formed as an integral part of the disposable container.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A liquid container for use with a pump which comprises:

a. a container having an opening, said opening being at the bottom of said container, b. a means secured in said opening comprising an intake valve for a pump, wherein said insert includes a first pathway and a second pathway, said first pathway extending above the liquid level in said container and said second pathway having a slug floating therein, said slug having an annular bevel at each of its top and bottom surfaces to restrict movement thereon in said pathway, one of said bevels communicating with said insert in a predetermined position of said slug to close said pathway.

2. A liquid container for use with a pump which comprises:

a. a container having an opening, said opening being at the bottom of said container, b. a means secured in said opening comprising an intake valve for a pump, said container further having a vent remote from said opening, said vent being positioned above the upper liquid level in said container, wherein said insert includes a first pathway and a second pathway, said first pathway extending above the liquid level in said container and said second pathway having a slug floating therein, said slug having an annular bevel at each of its top and bottom surfaces to restrict movement thereon in said pathway, one of said bevels communicating with said insert in a predetermined position of said slug to close said pathway.

3. A dispenser for dispensing liquid into the bowl of a toilet having a flush tank, which comprises:

a. pump means and b. a container for liquid, said container having a small orifice at one end and a vent at an end remote from said small opening, said orifice being sufficiently small so that liquid in said container does not exit therefrom when said vent is closed, and means for applying increased pressure to the interior of the container upon operation of the pump means by the water level in the tank, to eject liquid from the container orifice into said bowl.

4. A dispenser as set forth in claim 3 wherein said container includes an outlet and an insert secured in said outlet, said insert including said small orifice.

5. A dispenser for dispensing liquid into the bowl of a toilet having a flush tank, which comprises:

a. pump means, b. a container for liquid, said container having an opening, an insert secured in said container including an intake valve for said pump controlled by said pump means through a passageway therein, said container being removably mounted on said pump means, said pump means also including a further separate passageway communicating with said insert and said bowl, said insert including a passage communicating with said further passageway and extending within the tank above the level of liquid in the container, wherein said valve comprises an aperture and a floating slug in said aperture responsive to operation of said pump, said valve being normally opened and being closed responsive to an increase in pressure in said pump.

6. A dispenser for dispensing liquid into the bowl of a toilet having a flush tank, which comprises:

a. pump means, b. a container for liquid, said container having an opening, an insert secured in said container including an intake valve for said pump controlled by said pump means through a passageway therein, said container being removably mounted on said pump means, said pump means also including a further separate passageway communicating with said insert and the said bowl, said insert including a passage communicating with said further passageway and extending within the tank above the level of liquid in the container, wherein said valve comprises an aperture and a floating slug in said aperture responsive to operation of said pump, said valve being normally opened and being closed responsive to an increase in pressure in said valve, wherein said insert also includes the exhaust valve for said pump means.

7. A dispenser for dispensing liquid into the bowl of a toilet having a flush tank, which comprises:

a. a pump body having an outlet opening, b. a container for liquid mounted in said pump body and having an opening, c. interfitting means extending between the openings in the container and pump body for removably securing them together and having a passageway therein connecting the openings, d. an annular valve seat extending into said passageway, e. a floating slug in said passageway having an enlarged end on each side of said seat to maintain the slug in captured relation thereto, f. one of said enlarged ends forming a closure for said passageway when in engagement with said valve seat, g. said pump means having means responsive to a change in the level of water in the tank for applying pressure on the slug to engage said valve seat in order to close said passageway.

8. A dispenser as set forth in claim 7 including a further passageway through said interfitting means, a duct extending from one end of said further passageway into said container to a level above the liquid therein, and an additional passageway from the atmosphere through the pump body to said further passageway.

9. A dispenser for dispensing sanitizing fluid into the bowl of a toilet having a flush tank which comprises:

pump means, a fully enclosed container for said liquid except for an orifice which is sufficiently small to normally prevent liquid flow therethrough, said pump means including a body having a first passageway leading from said orifice to an outlet opening, a second passageway extending from atmosphere into the container and above the level of the liquid therein, means for cutting off the second passageway from atmosphere when the second passageway is at and above atmospheric pressure, and means responsive to the change in water level in the tank for operating said pump means to apply increased pressure to the interior of the container through said second passageway to eject said liquid through said orifice into the outlet opening and to said bowl.

10. A dispenser as set forth in claim 9 said container includes an insert secured therein, said orifice being in said insert, said second passageway including a tubular member secured to the insert and extending into the tank.

11. A dispenser as set forth in claim 10 wherein said insert and pump body include cooperating means for removably securing the container on the pump body, the first passageway leading to the orifice in the container, the second passageway having a portion extending through said pump body.

12. A dispenser for dispensing liquid into the bowl of a toilet having a flush tank, which comprises:

a. pump means, b. a container for liquid, said container having an opening, an insert secured in said container including an intake valve for said pump controlled by said pump means through a passageway therein, said container being removably mounted on said pump means, said pump means further includes a further separate passageway communicating with said insert and said bowl, said insert including a passage communicating with said further passageway and extending within the tank above the level of liquid in the container.

13. A dispenser as set forth in claim 12 wherein said insert also includes the exhaust valve for said pump.

14. A dispenser for dispensing sanitizing liquid into the bowl and flush tank of a toilet having a flush tank with an overflow to said bowl which comprises:

pump means, a fully enclosed container for said liquid having an orifice receiving said pump means, said pump means including a body having a first passageway leading from said container to a first outlet opening coupled to said overflow, a second outlet opening extending from said first passageway into said flush tank, and means responsive to the change in water level in the tank for operating said pump means to force liquid in said container through both of said outlets to eject said liquid simultaneously into said overflow and said flush tank.

15. A dispenser as set forth in claim 14 wherein the diameter of said first outlet opening is smaller than said second outlet opening.

* * * * *